US009250020B2

(12) United States Patent
Vikstrom et al.

(10) Patent No.: US 9,250,020 B2
(45) Date of Patent: Feb. 2, 2016

(54) ACTIVE LOUVER SYSTEM FOR CONTROLLED AIRFLOW IN A MULTI-FUNCTION AUTOMOTIVE RADIATOR AND CONDENSER SYSTEM

(75) Inventors: Per Thomas Vikstrom, Sunnyvale, CA (US); Vincent George Johnston, Half Moon Bay, CA (US); Franz von Holzhausen, Malibu, CA (US); Paul Daniel Yeomans, Oxfordshire (GB)

(73) Assignee: Tesla Motors, Inc., Palo Alto, CA (US)

( * ) Notice: Subject to any disclaimer, the term of this patent is extended or adjusted under 35 U.S.C. 154(b) by 613 days.

(21) Appl. No.: 13/468,836

(22) Filed: May 10, 2012

(65) Prior Publication Data

US 2012/0222833 A1 Sep. 6, 2012

Related U.S. Application Data

(63) Continuation-in-part of application No. 13/150,553, filed on Jun. 1, 2011.

(60) Provisional application No. 61/429,825, filed on Jan. 5, 2011.

(51) Int. Cl.

| | |
|---|---|
| ***B60H 1/00*** | (2006.01) |
| ***F28D 1/04*** | (2006.01) |
| ***F28F 27/02*** | (2006.01) |

(52) U.S. Cl.

CPC ..... *F28D 1/0443* (2013.01); *F28F 27/02* (2013.01)

(58) Field of Classification Search

CPC ..... B60H 1/00; F28F 27/00; F28F 24/02; B60K 11/85; F28D 1/0443

USPC ..... 165/41–44, 96, 98–103, 202; 180/68.1, 180/68.2, 68.4, 68.6

See application file for complete search history.

(56) References Cited

U.S. PATENT DOCUMENTS

| | | | | |
|---|---|---|---|---|
| 5,046,550 | A * | 9/1991 | Boll et al. | 165/41 |
| 5,732,666 | A * | 3/1998 | Lee | 123/41.05 |
| 6,475,077 | B2 * | 11/2002 | Arold | 454/156 |
| 7,455,136 | B2 * | 11/2008 | Pleune et al. | 180/68.1 |
| 8,561,738 | B2 * | 10/2013 | Charnesky et al. | 180/68.1 |
| 2003/0019232 | A1 * | 1/2003 | Matsuo et al. | 62/244 |
| 2010/0025006 | A1 | 2/2010 | Zhou | |
| 2010/0104938 | A1 | 4/2010 | Hermann | |
| 2010/0243352 | A1 * | 9/2010 | Watanabe et al. | 180/68.1 |
| 2011/0296855 | A1 | 12/2011 | Johnston et al. | |
| 2011/0308763 | A1 * | 12/2011 | Charnesky et al. | 165/41 |
| 2012/0168125 | A1 | 7/2012 | Johnston et al. | |

* cited by examiner

*Primary Examiner* — Travis Ruby
(74) *Attorney, Agent, or Firm* — J. Richard Soderberg

(57) ABSTRACT

A vehicle thermal management system is provided that includes two or more heat exchangers configured in a non-stacked arrangement, where separate air inlets corresponding to each of the heat exchangers allow a direct intake of ambient air. Active louver systems consisting of sets of adjustable louvers and a control actuator are used to control and regulate air flowing directly into one or more of the heat exchangers, where the adjustable louvers are either adjustable between two positions, i.e., opened and closed, or adjustable over a range of positions. Air ducts may be used to couple the output from one heat exchanger to the input of a different heat exchanger.

20 Claims, 12 Drawing Sheets

ACTIVE LOUVER SYSTEM FOR CONTROLLED AIRFLOW IN A MULTI-FUNCTION AUTOMOTIVE RADIATOR AND CONDENSER SYSTEM

CROSS-REFERENCE TO RELATED APPLICATION

This application is a continuation-in-part of U.S. patent application Ser. No. 13/150,553, filed 1 Jun. 2011, which claims benefit of the filing date of U.S. Provisional Patent Application Ser. No. 61/429,825, filed 5 Jan. 2011, the disclosures of which are incorporated herein by reference for any and all purposes.

FIELD OF THE INVENTION

The present invention relates generally to vehicles and, more particularly, to an automotive radiator and condenser airflow system.

BACKGROUND OF THE INVENTION

Vehicle cooling systems vary widely in complexity, depending primarily upon the thermal requirements of the various vehicle systems employed in the vehicle in question. In general, these cooling systems utilize heat exchangers of one form or another to transfer the heat generated by the vehicle subsystems to the surrounding ambient environment. Such heat transfer may either be performed directly, for example in the case of a simple radiator coupled to a vehicle engine, or indirectly, for example in the case of a thermal management system utilizing multiple heat transfer circuits to transfer the heat through multiple stages in order to sufficiently lower the temperature of the component in question.

In general, vehicle heat exchangers are designed to exchange heat between two different fluids, or two similar fluids that are at different temperatures, thereby helping to maintain the various vehicle systems and components within a safe and effective operating range of temperatures. One of the fluids is typically composed of a refrigerant or water, the water often mixed with ethylene glycol or propylene glycol or a similar liquid that provides anti-freeze protection at low temperatures. In many vehicle heat exchangers such as condensers and radiators, the second fluid is air which is forced to flow through the heat exchanger, either as a result of vehicle movement or through the use of a fan.

Within the automotive industry there are several types of air heat exchangers, the design of each being based on their intended application. Exemplary heat exchangers include:

- A powertrain radiator in which a coolant-to-air heat exchanger is used to remove heat from an internal combustion engine or electric motor.
- A condenser in which a refrigerant-to-air heat exchanger is used to remove heat for cabin air conditioning systems or other systems (e.g., battery packs and power electronics) that employ refrigerant as the cooling fluid.
- A transmission oil cooler in which an oil-to-air heat exchanger is used to remove heat from the transmission via the transmission fluid.
- A steering pump oil cooler in which an oil-to-air heat exchanger is used to remove heat from the steering system via the steering fluid.
- A charge air cooler in which an air-to-air heat exchanger is used to remove heat from turbocharged (compressed) air used in the engine intake system.

For a given set of fluid temperatures, the performance of a fluid-to-fluid heat exchanger depends primarily on the surface area of the heat exchanger and the volume flow rate of the two fluids through the heat exchanger. Flow rate is commonly determined as the fluid velocity through the heat exchanger multiplied by the frontal area of the heat exchanger. Larger heat exchanger surface areas and mass flow rates result in greater heat transfer from the inner fluid to the outer fluid. An increase in these same variables, however, also results in an increase in the hydraulic losses, or pressure drop losses, which are manifested in increased aerodynamic drag (i.e., vehicle motive power), pump power, and fan power. Additionally, in a fluid-to-fluid heat exchanger, the transfer of heat between the two fluids increases as the temperature difference between the two fluids increases.

In a conventional vehicle utilizing multiple heat exchangers, regardless of whether the vehicle utilizes a combustion engine, an electric motor, or a combination of both (i.e., a hybrid), the individual heat exchangers are typically positioned one in front of the other, followed by a fan, this configuration referred to as a "stack". In such a stacking arrangement, commonly the heat exchanger with the lowest outlet air temperature is located upstream, followed by higher temperature heat exchangers downstream. An example of such a configuration is a condenser followed directly by an engine radiator, followed by one or more fans. While this arrangement is more common with vehicles utilizing a combustion engine, hybrid vehicles may also use a stack of heat exchangers in order to provide cooling for the battery pack, power electronics and the motor. A principal drawback of the practice of stacking heat exchangers is an increase in hydraulic losses (i.e., fan power, aerodynamic drag) that result regardless of whether each heat exchanger in the stack is in active use. Additionally, since the temperature of the air entering the inner heat exchanger(s) will be the temperature of the air exiting the upstream heat exchanger which is typically higher than the ambient temperature, the efficiency and overall performance of the inner heat exchanger(s) is compromised. As a consequence, it is common practice to increase the surface area or thickness of the downstream heat exchangers to compensate for this decrease in expected performance which, in turn, adds weight and cost to the affected heat exchangers.

In an alternate arrangement, disclosed in co-pending U.S. patent application Ser. No. 13/150,553, a vehicle thermal management system is described utilizing multiple heat exchangers configured in a non-stacked arrangement. This arrangement maximizes heat transfer while minimizing the hydraulic power consumed in the process. The present invention provides an improved louver system for controlling air flow through such an arrangement of non-stacked heat exchangers.

SUMMARY OF THE INVENTION

A vehicle thermal management system is provided that is comprised of at least first and second heat exchangers configured in a non-stacked arrangement, wherein the first heat exchanger is coupled to a first vehicle cooling subsystem and the second heat exchanger is coupled to a second vehicle cooling subsystem; a first air inlet, wherein air flowing through the first air inlet flows directly into the first heat exchanger without first passing through the second heat exchanger; a second air inlet, wherein air flowing through the second air inlet flows directly into the second heat exchanger without first passing through the first heat exchanger; and an active louver system comprising a plurality of adjustable louvers that control air flowing directly through the second air inlet into the second heat exchanger, and an actuator coupled to the plurality of adjustable louvers that control the positioning of the louvers between at least a first position (e.g., fully opened) and a second position (e.g., fully closed). The actuator coupled to the adjustable louvers may be, for example, an electro-mechanical actuator or a hydraulic actuator. The actuator may control positioning of the adjustable louvers over a range of positions. The louvers may be coupled together using multiple links of a multi-link system. The louvers may be mounted within an air inlet aperture located between upper and lower bumper assemblies. Each louver may pivot about a pivot axis located along the front edge of the louver. The actuator may be coupled to a control processor, where the control processor controls louver positioning via the actuator. The system may further comprise a fan adjacent to the airflow exit surface of the second heat exchanger.

In another aspect of the invention, an air duct couples at least a portion of the airflow exit surface of the first heat exchanger to the airflow entrance surface of the second heat exchanger. A second set of adjustable louvers, located within the air duct and between the airflow exit surface of the first heat exchanger and the airflow entrance surface of the second heat exchanger, may be included to provide control of air flowing between the first and second heat exchangers within the air duct. The second set of adjustable louvers may have two positions, i.e., opened and closed, or adjustable over a range of positions between opened and closed.

In another aspect of the invention, the first heat exchanger may be centrally mounted along the vehicle centerline with the second heat exchanger mounted in a position adjacent to the first heat exchanger. The system may further include a third heat exchanger configured in a non-stacked arrangement with the first and second heat exchangers and mounted adjacent to the first heat exchanger and on an opposite side of the first heat exchanger relative to the second heat exchanger. In this configuration, a third air inlet is provided such that air flowing through the third air inlet flows directly into the third heat exchanger without first passing through the first or second heat exchangers. This configuration also includes a second plurality of adjustable louvers that control air flowing directly through the third air inlet into the third heat exchanger, and a second actuator coupled to the second plurality of adjustable louvers that control the positioning of the louvers between at least a first position (e.g., fully opened) and a second position (e.g., fully closed). Preferably the first and second actuators are independent from one another. The system may further comprise a first fan adjacent to the airflow exit surface of the second heat exchanger and a second fan adjacent to the airflow exit surface of the third heat exchanger. The system may further comprise a first air duct coupling at least a portion of the airflow exit surface of the first heat exchanger to the airflow entrance surface of the second heat exchanger and a second air duct coupling at least a second portion of the airflow exit surface of the first heat exchanger to the airflow entrance surface of the third heat exchanger. In this configuration a third set of adjustable louvers may be located within the first air duct and between the airflow exit surface of the first heat exchanger and the airflow entrance surface of the second heat exchanger, and a fourth set of adjustable louvers may be located within the second air duct and between the airflow exit surface of the first heat exchanger and the airflow entrance surface of the third heat exchanger.

A further understanding of the nature and advantages of the present invention may be realized by reference to the remaining portions of the specification and the drawings.

DESCRIPTION OF THE SPECIFIC EMBODIMENTS

In the following text, the term "battery pack" refers to multiple individual batteries contained within a single piece or multi-piece housing, the individual batteries electrically interconnected to achieve the desired voltage and capacity for a particular application. The term "electric vehicle" as used herein may refer to an all-electric vehicle, also referred to as an EV, a plug-in hybrid vehicle, also referred to as a PHEV, or a hybrid vehicle, also referred to as a HEV, where a hybrid vehicle refers to a vehicle utilizing multiple propulsion sources one of which is an electric drive system.

Figure 1:
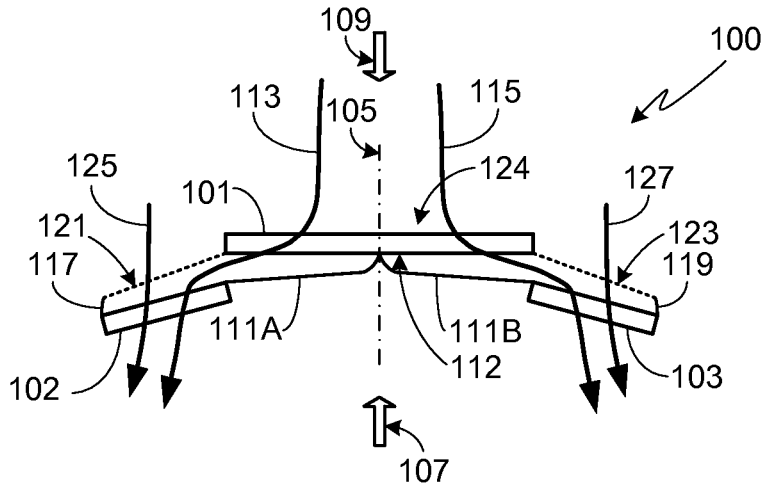
FIG. 1 provides a simplified view of a vehicle thermal management system in accordance with the invention.

FIG. 1 provides a simplified view of a vehicle thermal management system that may be used with the louver system of the invention. System 100 includes three heat exchangers 101-103; more specifically, central heat exchanger 101 and a pair of heat exchangers 102/103 that are mounted on either side of central heat exchanger 101. Heat exchangers 101-103 are thermally coupled to one or more vehicle cooling subsystems (e.g., battery cooling subsystem, refrigeration subsystem, passenger cabin HVAC subsystem, power electronics cooling subsystem, motor and/or transmission cooling subsystem, charging system cooling subsystem, etc.). While the use of three heat exchangers is preferred, it should be understood that the invention described herein is equally applicable to thermal management systems utilizing only a pair of side-by-side exchangers, e.g., heat exchangers 101 and 102 or heat exchangers 101 and 103, or systems utilizing more than three heat exchangers. System 100 is designed to provide symmetry about central vehicular axis 105. Note that in this configuration, forward vehicle motion is shown by arrow 107, resulting in airflow through the heat exchangers in direction 109.

Thermal management system 100, as with other illustrated embodiments described herein, includes a number of air ducts that control the flow of air through, or around, the heat exchangers. In the system illustrated in FIG. 1, rear ducting 111A prevents air from flowing unimpeded through heat exchanger 101. Rather, the air that flows through the left side of heat exchanger 101 and exits rear heat exchanger surface 112 is forced to flow through heat exchanger 102, following path 113. Similarly, rear ducting 111B forces air flowing through the right side of heat exchanger 101 and exiting rear heat exchanger surface 112 to pass through heat exchanger 103, following path 115. Note that in this and other preferred embodiments, ducting section 117 prevents air from flowing through the left side of heat exchanger 101 without also passing through heat exchanger 102. Similarly, ducting section 119 prevents air from flowing through the right side of heat exchanger 101 without also passing through heat exchanger 103. Alternate embodiments eliminate ducting sections 117/119, thus allowing air to flow through central heat exchanger 101 and then exit the system without also passing through one of the side-mounted heat exchangers 102/103. Note that adjustable louvers may be positioned at ducting sections 117/119, thus controlling whether the air flowing through the central heat exchanger 101 passes through a side-mounted heat exchanger.

The forward portions of the air ducting include a pair of air inlets 121 and 123, shown in phantom, which are positioned in front of heat exchangers 102 and 103, respectively. Additionally, the entrance 124 to the central heat exchanger 101 forms a third air inlet that provides a pathway for air to flow directly into heat exchanger 101. Air duct inlet 121 provides an airflow path 125 that bypasses heat exchanger 101 as shown. Similarly, air duct inlet 123 allows air to flow directly through heat exchanger 103 without passing through central heat exchanger 101, following path 127.

Figure 2:
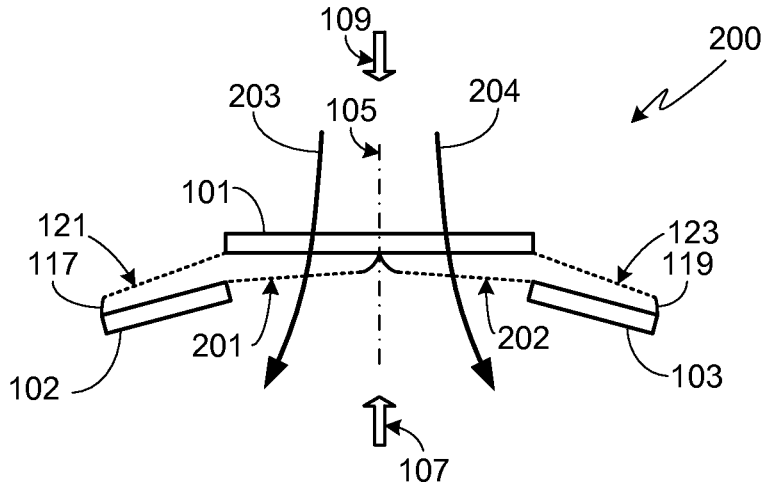
FIG. 2 illustrates the vehicle thermal management system shown in FIG. 1, modified to allow air to pass unimpeded through the central heat exchanger.

Thermal management system 200, shown in FIG. 2, illustrates a minor modification of the air ducts of system 100. In the illustrated system, at least a portion of rear ducting 111A/111B is modified to include air exhaust ports 201 and 202. Outlets 201 and 202 allow air passing through heat exchanger 101 to flow out of the back of heat exchanger 101 without also passing through one or both heat exchangers 102 and 103 (e.g., pathways 203/204). Depending upon the size of outlets 201 and 202 as well as the amount of air flowing through heat exchanger 101, air may or may not follow pathways 113 and 115 shown in FIG. 1. As with system 100, air passing through inlets 121/123 will flow directly through the side heat exchangers without first passing through central heat exchanger 101.

Figure 3:
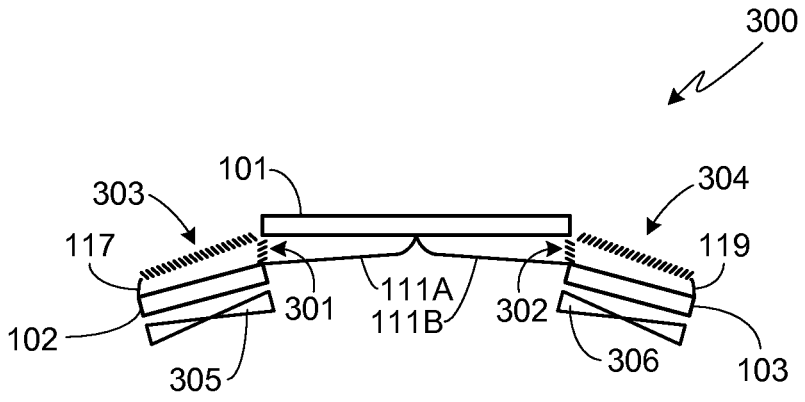
FIG. 3 illustrates a preferred embodiment based on the thermal management system shown in FIG. 1.

FIG. 3 illustrates a preferred embodiment of the thermal management system shown in FIG. 1. System 300 includes four sets of louvers 301-304 that provide means for controlling the flow of air through heat exchangers 101-103. In addition to providing independent control of the flow of air through the side heat exchangers versus the central heat exchanger, preferably louvers 301-304 are completely independent from one another, thereby providing even finer thermal management control. Preferably system 300 includes at least one fan, and more preferably at least two fans 305/306, to augment airflow by drawing air through the heat exchangers or, in some embodiments, blowing air through the heat exchangers.

Figure 4:
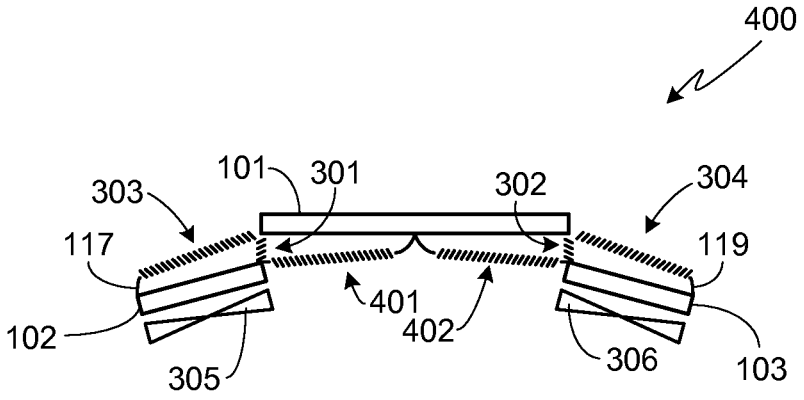
FIG. 4 illustrates an alternate embodiment based on the thermal management system shown in FIG. 2.

FIG. 4 illustrates a preferred embodiment of the thermal management system shown in FIG. 2. In this embodiment, the system not only includes louvers 301-304, but also louvers 401 and 402 as shown. Louvers 401 and 402 control whether the air that passes through central heat exchanger 101 also passes through a side-mounted heat exchanger, i.e., heat exchanger 102 and/or 103, or simply flow through the central heat exchanger following a pathway 203/204. It will be appreciated that a fan, or fans, may be mounted at one or both air outlets 201/202.

Figure 5:
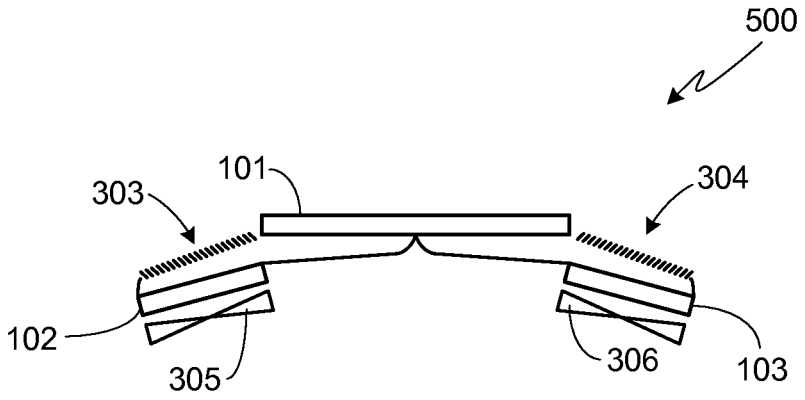
FIG. 5 illustrates an alternate embodiment utilizing only a portion of the louvers shown in FIG. 3.
Figure 6:
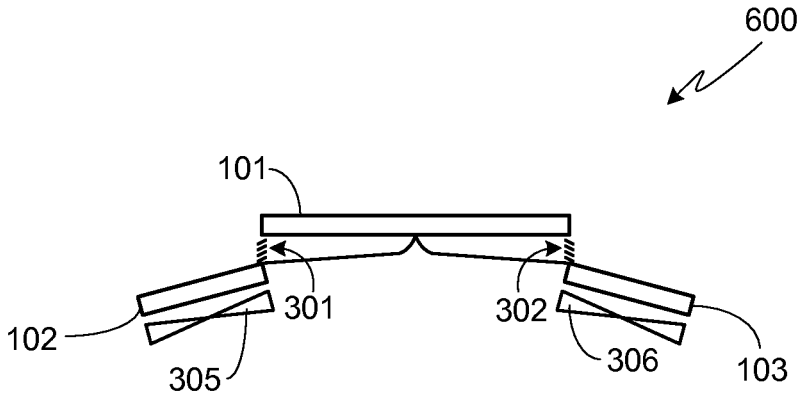
FIG. 6 illustrates another alternate embodiment utilizing only a portion of the louvers shown in FIG. 3.

While the use of multiple louvers 301-304 and 401-402 maximizes airflow control through heat exchangers 101-103, it should be understood that the invention may utilize a different number of control louvers, depending primarily upon the constraints and requirements placed on the thermal management system by the vehicle's design. For example, system 500 shown in FIG. 5 only includes outboard louvers 303 and 304 and system 600 shown in FIG. 6 only includes inboard louvers 301 and 302.

Figure 7:
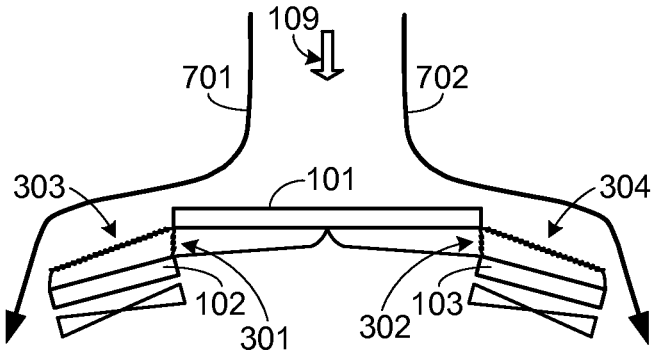
FIG. 7 provides a first airflow pattern for a given arrangement of the louvers shown in the thermal management system of FIG. 3.
Figure 8:
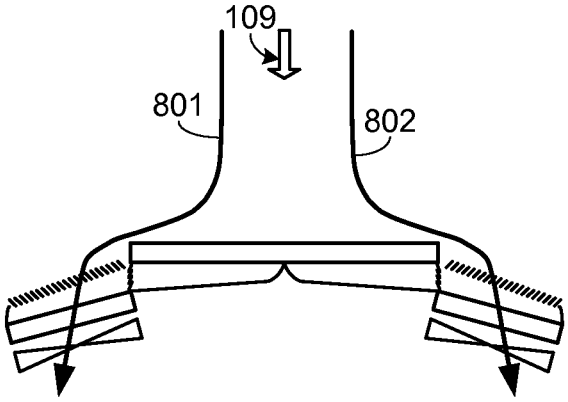
FIG. 8 provides a second airflow pattern for a given arrangement of the louvers shown in the thermal management system of FIG. 3.
Figure 9:
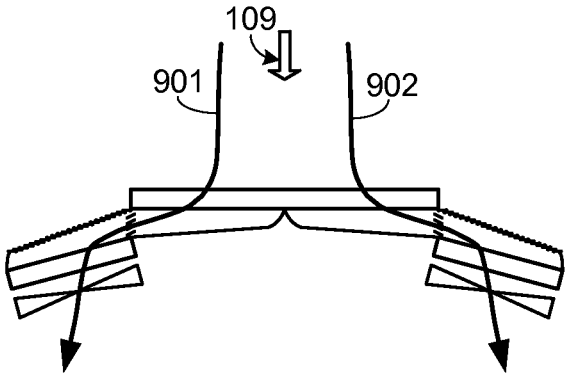
FIG. 9 provides a third airflow pattern for a given arrangement of the louvers shown in the thermal management system of FIG. 3.
Figure 10:
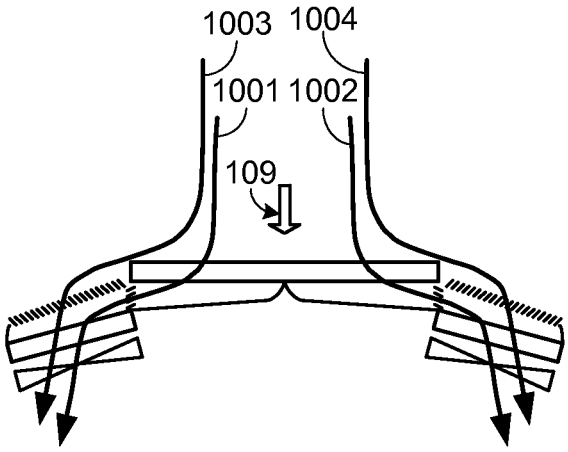
FIG. 10 provides a fourth airflow pattern for a given arrangement of the louvers shown in the thermal management system of FIG. 3.

FIGS. 7-12 illustrate a variety of airflow paths through preferred system 300, the designated flow path depending upon the relative positions of louvers 301-304. In FIG. 7, louvers 301-304 are completely closed. As a result, the air flowing in direction 109, which is due to the forward movement of the vehicle, bypasses heat exchangers 101-103 altogether and instead follows pathways 701/702. In FIG. 8, louvers 303 and 304, positioned in front of heat exchangers 102 and 103, respectively, are open while louvers 301 and 302 are closed. This arrangement causes the incoming air to follow pathways 801 and 802 through heat exchangers 102 and 103, respectively, while bypassing heat exchanger 101. In FIG. 9, louvers 301 and 302 which control the flow of air through the left and right sides of heat exchanger 101 are in an open position while louvers 303 and 304 are closed. Due to the ducting, the air flowing through heat exchanger 101 must also pass through heat exchangers 102 and 103 following airflow paths 901 and 902. Since the air flowing through heat exchangers 102 and 103 must first pass through heat exchanger 101, typically the air flowing through heat exchangers 102/103 will be at a higher temperature than the ambient temperature unless coolant is by-passing this heat exchanger and not adding heat to the airstream. In FIG. 10, all louvers 301-304 are in an open position. As a result, air will flow through all three heat exchangers, i.e., following pathways 1001 and 1002 through center heat exchanger 101 and following pathways 1003 and 1004 through side-mounted heat exchangers 102 and 103.

Figure 11:
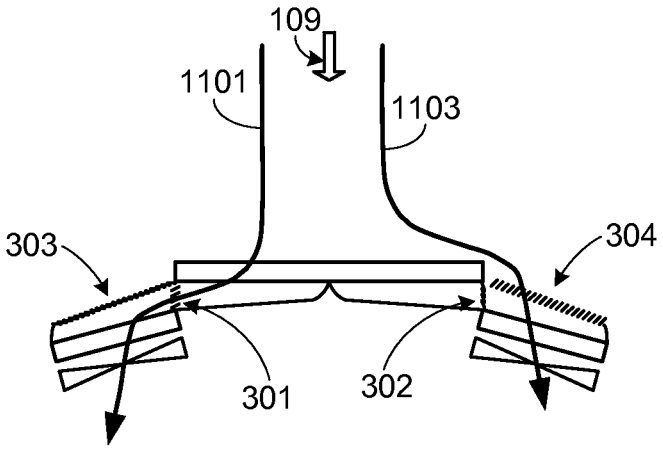
FIG. 11 provides a fifth airflow pattern for a given arrangement of the louvers shown in the thermal management system of FIG. 3.

As previously noted, preferably the louvers are completely independent from one another. This allows fine tuning of the thermal management system depending upon the requirements of the vehicle subsystems to which the various heat exchangers are coupled. The arrangement shown in FIG. 11 illustrates this flexibility. Specifically, on the left side of the vehicle, louver 301 is in the open position while louver 303 is in the closed position. As a result, most of the air flowing against the left side of the vehicle will follow pathway 1101 and pass first through heat exchanger 101, and then through heat exchanger 102. On the right side of the vehicle, louver 302 is in the closed position and louver 304 is in the open position, thus causing most of the air flowing against the right side of the vehicle to pass directly through heat exchanger 103 following pathway 1103 rather than first going through heat exchanger 101.

Figure 12:
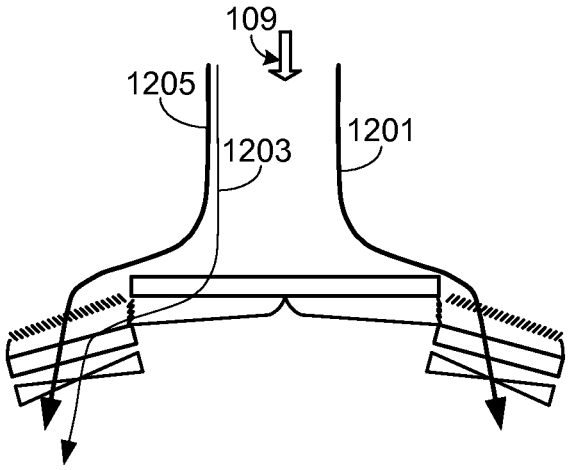
FIG. 12 provides a sixth airflow pattern for a given arrangement of the louvers shown in the thermal management system of FIG. 3.

In at least one preferred embodiment, the louvers may be positioned in a range of positions from fully open to fully closed, thus allowing fine modulation of the airflow. As a result of allowing a range of louver positions, the thermal management system may be fine-tuned to insure efficient use of the heat exchangers, i.e., achieving the airflow required for cooling while minimizing hydraulic and aerodynamic losses. This aspect of the invention is illustrated in FIG. 12, based on preferred system 300. In this figure, louver 302 on the right side of the vehicle is fully closed and louver 304 is fully opened, thus causing the air flowing against the right side of the vehicle to pass directly through heat exchanger 103 following pathway 1201. On the left side of the vehicle, louver 301 is opened to a small degree, thus allowing only a small portion of air to follow path 1203 through both heat exchanger 101 and heat exchanger 102. Additionally, on this side of the vehicle louver 303 is opened to the maximum extent possible, causing most of the air on this side of the vehicle to follow path 1205 and pass through heat exchanger 102 without first passing through heat exchanger 101.

Figure 13:
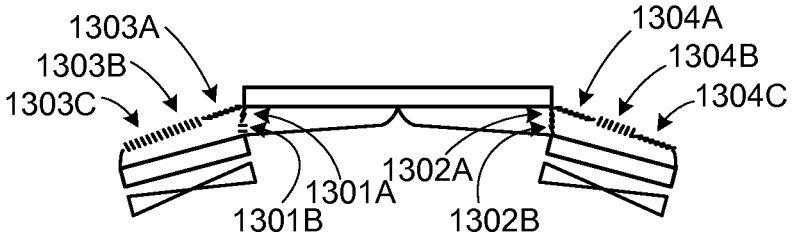
FIG. 13 illustrates an alternate embodiment of the thermal management system shown in FIG. 3.

In an alternate embodiment, fine adjustment of the air flowing through the louvers is achieved by utilizing two or more sets of louvers for each opening where fine control is desired. Preferably each set of louvers is only capable of two positions: fully open or fully closed, thus simplifying louver operation. In an exemplary configuration shown in FIG. 13 and based on system 300, louvers 301 and 302 have each been replaced by two sets of louvers each, i.e., 1301A/1301B and 1302A/1302B, respectively. Louvers 303 and 304 have each been replaced by three sets of louvers each, i.e., 1303A/1303B/1303B and 1304A/1304B/1304C, respectively. In the illustrated configuration, one of the louvers that controls the airflow through the left side of heat exchanger 101, louver 1301A, is closed while the other louver in this set, louver 1301B, is open. Both louvers 1302A and 1302B that control airflow through the right side of heat exchanger 101 are closed in this figure. In front of heat exchanger 102, louvers 1303B and 1303C are shown open, while louver 1303A is closed. In front of heat exchanger 103, two sets of louvers, i.e., louvers 1304A and 1304C are closed while the middle set of louvers, 1304B, is open. It will be appreciated that each air duct opening may use less than the illustrated number of louver sets, or more than the illustrated number of louver sets.

Figure 14:
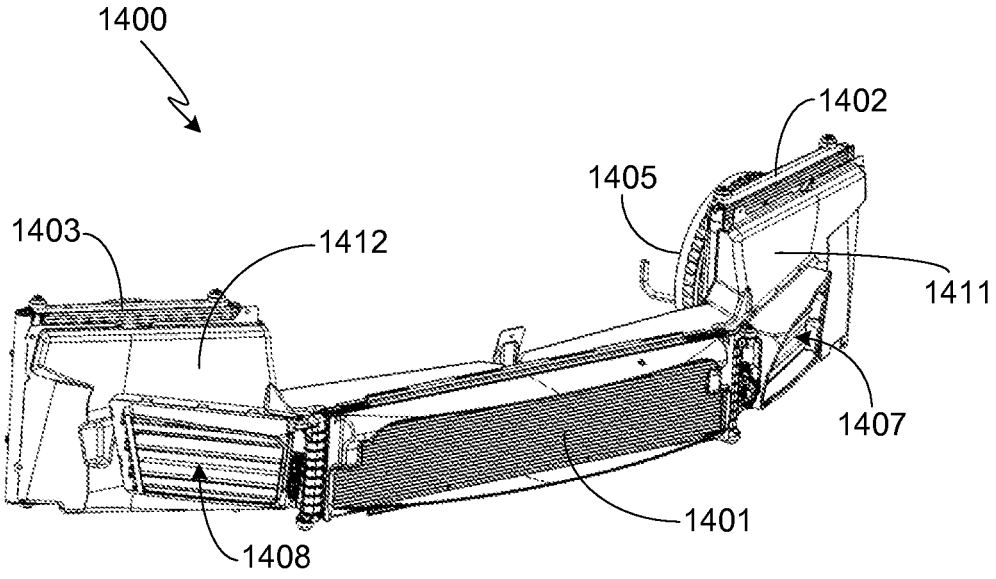
FIG. 14 provides a front, perspective view of a preferred thermal management system.
Figure 15:
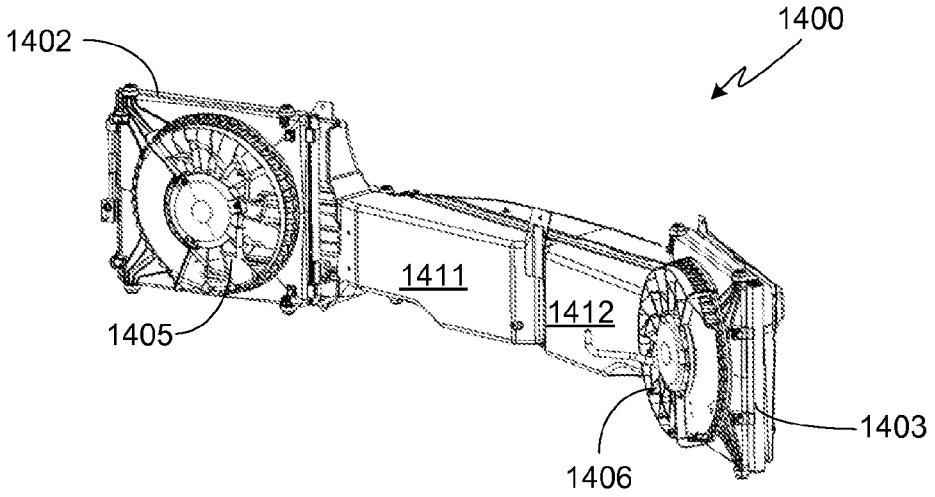
FIG. 15 provides a rear, perspective view of the thermal management system shown in FIG. 14.
Figure 16:
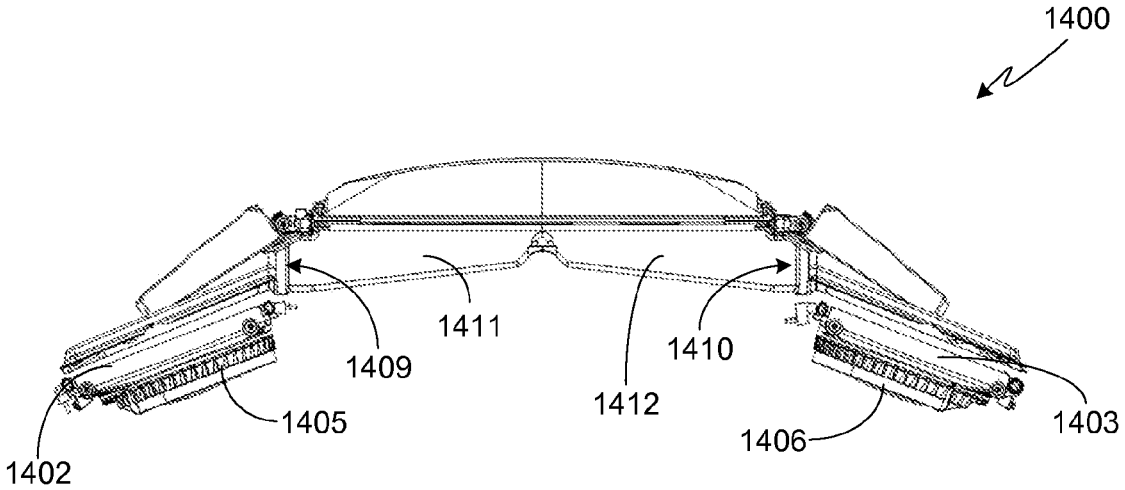
FIG. 16 provides a top view of the thermal management system shown in FIGS. 14 and 15.

FIGS. 14-16 illustrate a preferred implementation of a thermal management system utilizing three heat exchangers as shown in FIGS. 1-13. FIG. 14 provides a front, perspective view of assembly 1400; FIG. 15 provides a rear, perspective view of assembly 1400; and FIG. 16 provides a view from above assembly 1400. In assembly 1400, the central heat exchanger 1401 is a radiator, and the left-side and right side heat exchangers, 1402 and 1403 respectively, are condensers. It will be appreciated that due to the fans, louvers and ducting, heat exchangers 1402 and 1403 are not clearly visible. Situated behind heat exchangers 1402 and 1403 are fans 1405 and 1406, respectively. Louvers 1407 and 1408, positioned in front of heat exchangers 1402 and 1403, respectively, are clearly shown in FIG. 14. Note that louvers 1407 and 1408 are horizontal louvers as preferred, rather than the vertical louvers shown in FIGS. 3-13. Louvers 1409 and 1410 control the airflow through the left and right sides, respectively, of central heat exchanger 1401. Note that as louvers 1409 and 1410 are located within the air ducts as previously described relative to FIGS. 3-13, they are not clearly visible in FIGS. 14-16. Also visible in FIGS. 14-16 are the left and right air ducts 1411 and 1412, respectively.

Figure 17:
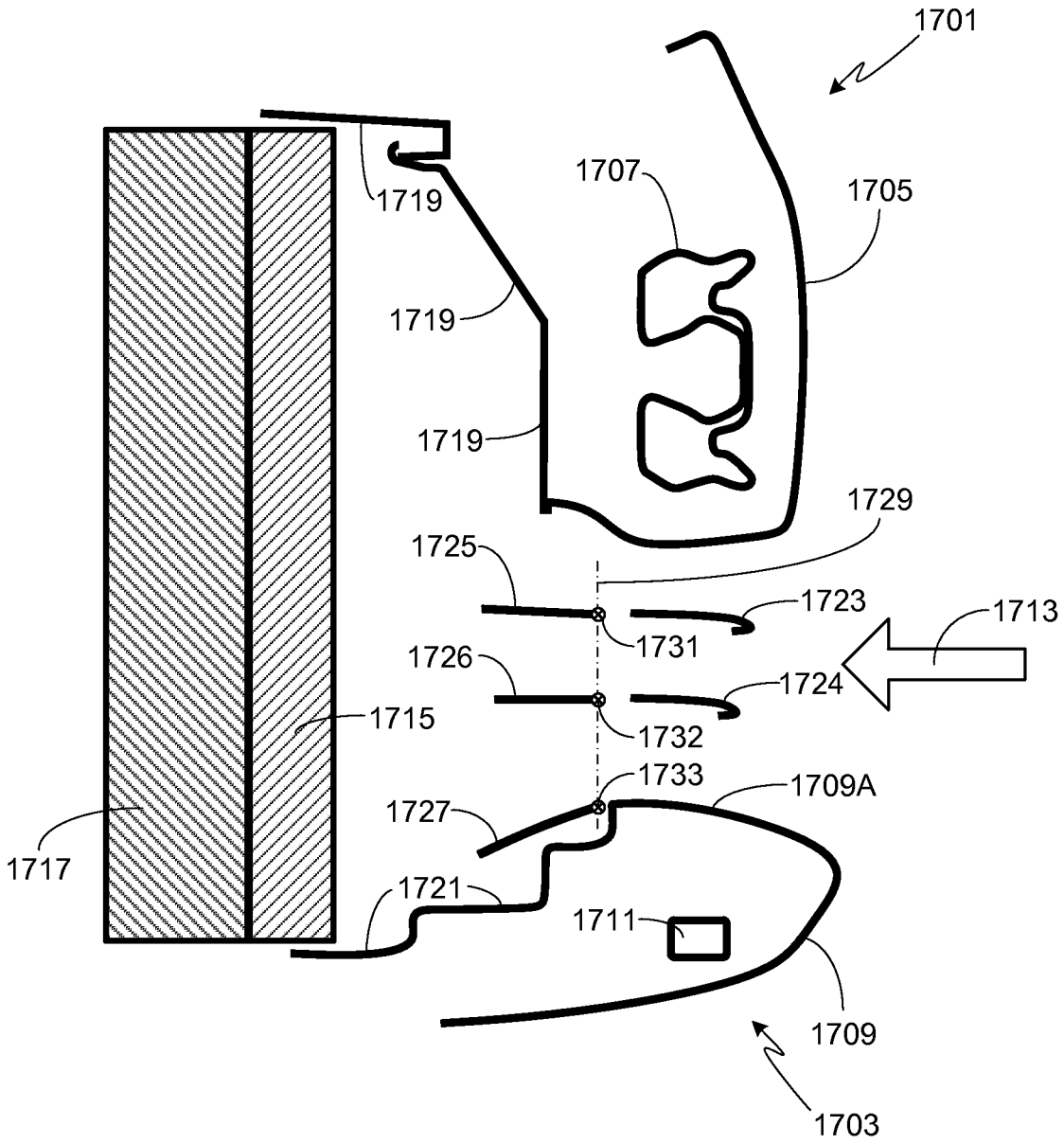
FIG. 17 provides a cross-sectional view of an active louver system in accordance with a preferred embodiment of the invention.
Figure 18:
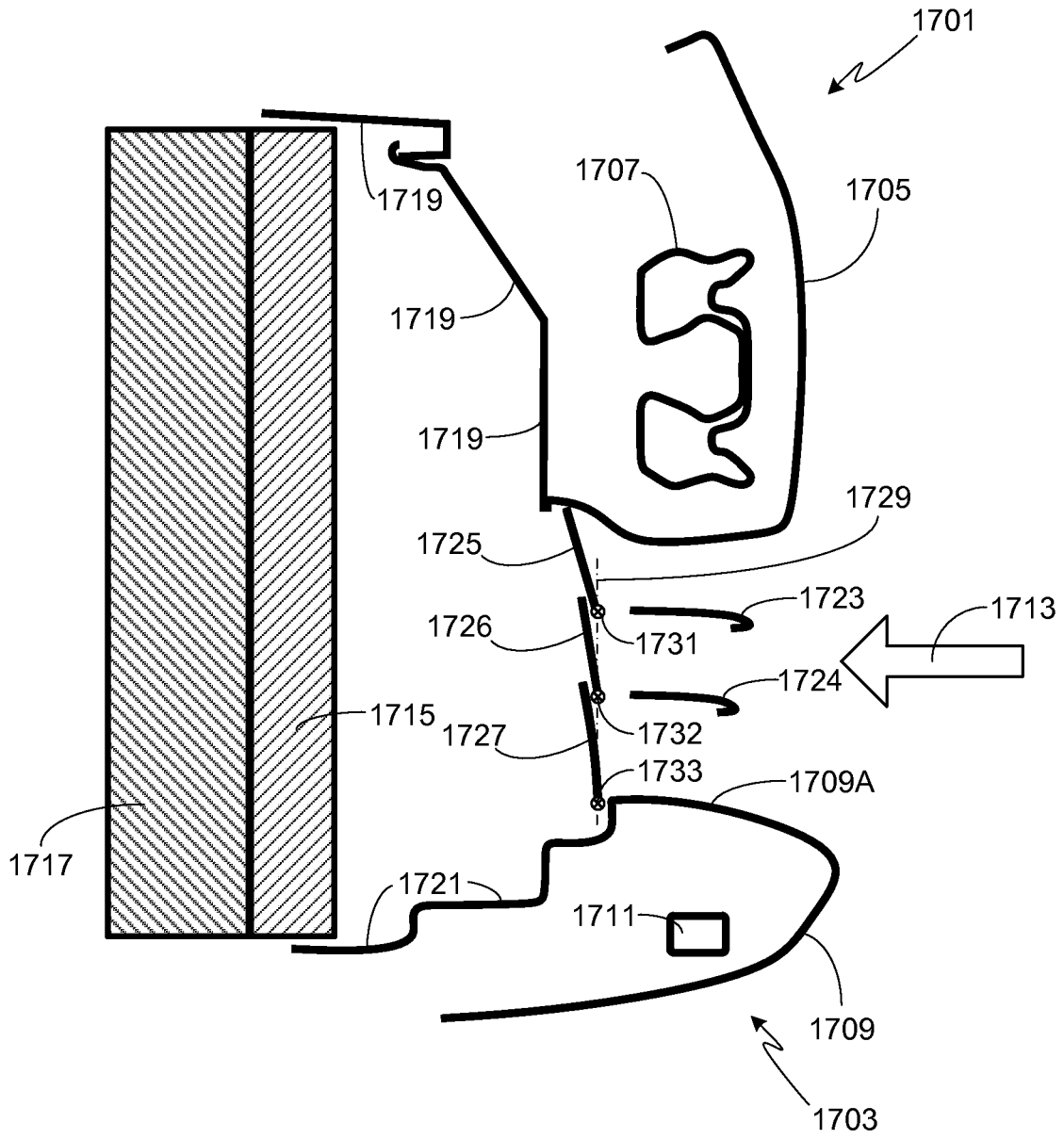
FIG. 18 provides a similar cross-sectional view of the active louver system shown in FIG. 17 with the louvers completely closed.
Figure 19:
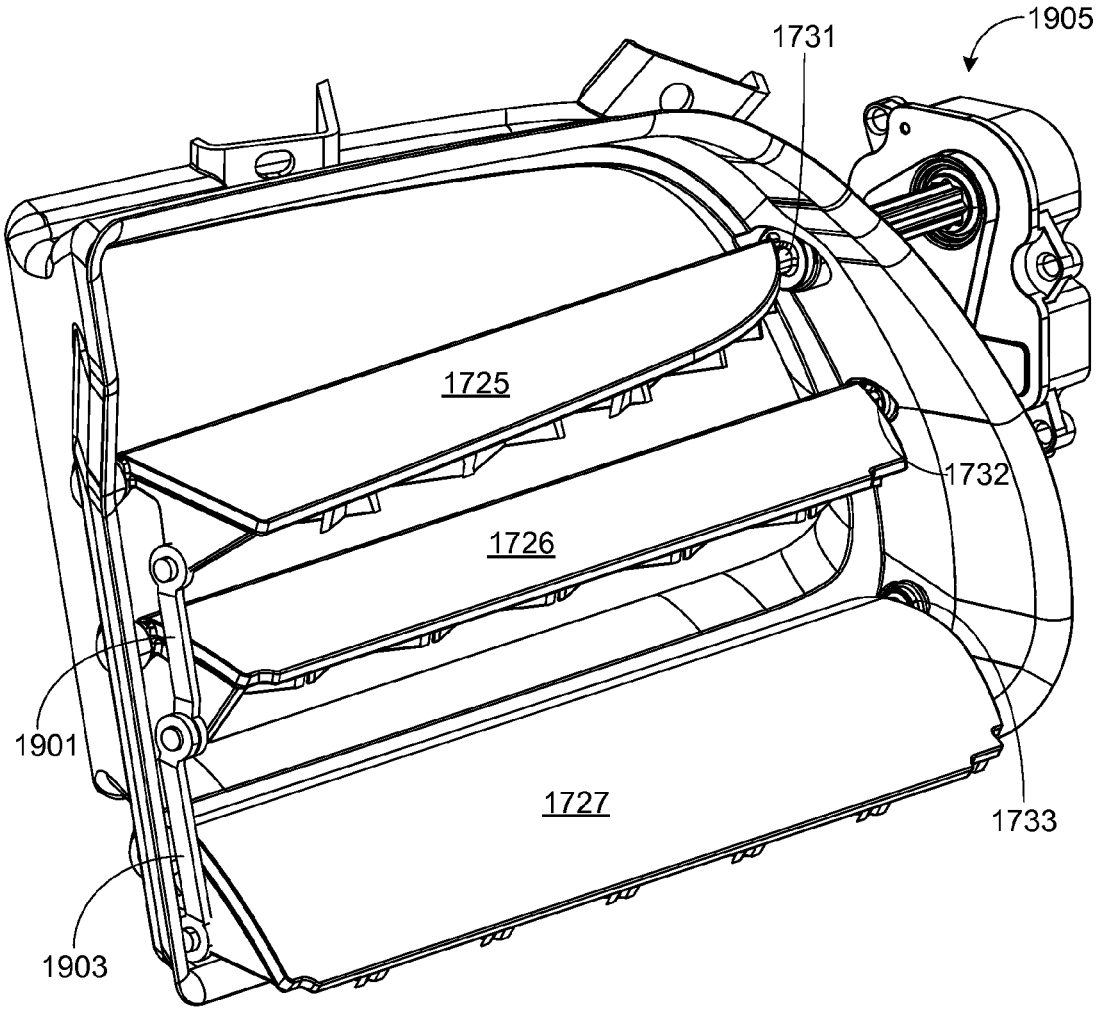
FIG. 19 provides a rear view of the active louver system shown in FIGS. 17 and 18.

FIGS. 17-19 illustrate a preferred embodiment of an active louver system in accordance with the invention, preferably for use with an outboard mounted heat exchanger such as heat exchangers 102/103 shown in FIGS. 1-13 and heat exchangers 1402/1403 shown in FIGS. 14-16. FIG. 17 provides a cross-sectional view of the louver system integrated within the front vehicle assembly. In this view both an upper bumper assembly 1701 and a lower bumper assembly 1703 are visible. Upper bumper assembly 1701 includes a fascia 1705 covering the primary bumper member 1707. Similarly, lower bumper assembly 1703 includes a fascia 1709 covering the secondary bumper member 1711. During forward vehicle movement, air flows between the upper bumper assembly 1701 and the lower bumper assembly 1703 in a direction 1713, where it then passes through heat exchanger 1715 (e.g., a condenser). As previously noted, air can also be drawn through the front vehicle assembly and through heat exchanger 1715, for example by using a fan 1717. Note that in the preferred embodiment, upper bumper assembly 1701 includes multiple duct surfaces 1719 and lower bumper assembly 1703 includes multiple duct surfaces 1721, surfaces 1719 and 1721 directing the air that enters the front vehicle assembly through heat exchanger 1715 rather than allowing it to bypass the heat exchanger.

In the illustrated and preferred embodiment, multiple trim pieces 1723/1724 are rigidly mounted between upper bumper assembly 1701 and lower bumper assembly 1703. Note that trim pieces 1723/1724 look like louvers as viewed from the front of the vehicle. Trim pieces 1723/1724 are primarily cosmetic in nature.

Recessed within the front vehicle assembly, and located between the upper and lower bumper assemblies, are multiple active louvers. In the preferred embodiment, the system uses three louvers 1725-1727. As shown in FIG. 17, open louvers 1725 and 1726 are aligned with trim pieces 1723 and 1724, respectively, while lowermost louver 1727 is configured and shaped to continue the curvature of the upper surface 1709A of fascia 1709, thereby minimizing disruption of the airflow entering through the front vehicle assembly. When closed, as shown in FIG. 18, the plane 1729 of the louvers is positioned in a relatively forward position, thus minimizing drag and providing improved aerodynamic performance. Note that louvers 1725-1727 pivot about pivot axes 1731-1733, respectively. Locating the pivot axis at the front of each louver simplifies integration into the front vehicle assembly, both in terms of limiting interference between the louvers and the louver housing and achieving minimal air leakage around the closed louvers. Due to the location of louvers 1725-1727 behind the aperture perimeter, when they are closed they are relatively hidden from view. Additionally, the location of the louvers allows fixed trim pieces 1723/1724 to further hide the louvers from view without impacting their performance when open, as shown in FIG. 17.

FIG. 19 provides a rear view of the active louver system, this view providing additional details with respect to the louver control system. As shown, louvers 1725-1727 are coupled together via a multi-link system comprised of upper link 1901 and lower link 1903. This type of linkage system allows the opening angle between louvers to be varied and optimized to minimize air flow disruption. Actuator 1905 controls louver motion. Actuator 1905 is preferably an electro-mechanical actuator, although other actuator types may be used (e.g., hydraulic). Actuator 1905 may be a simple two position actuator, i.e., opened and closed, or variable as preferred, thereby allowing system performance to be optimized.

Figure 20:
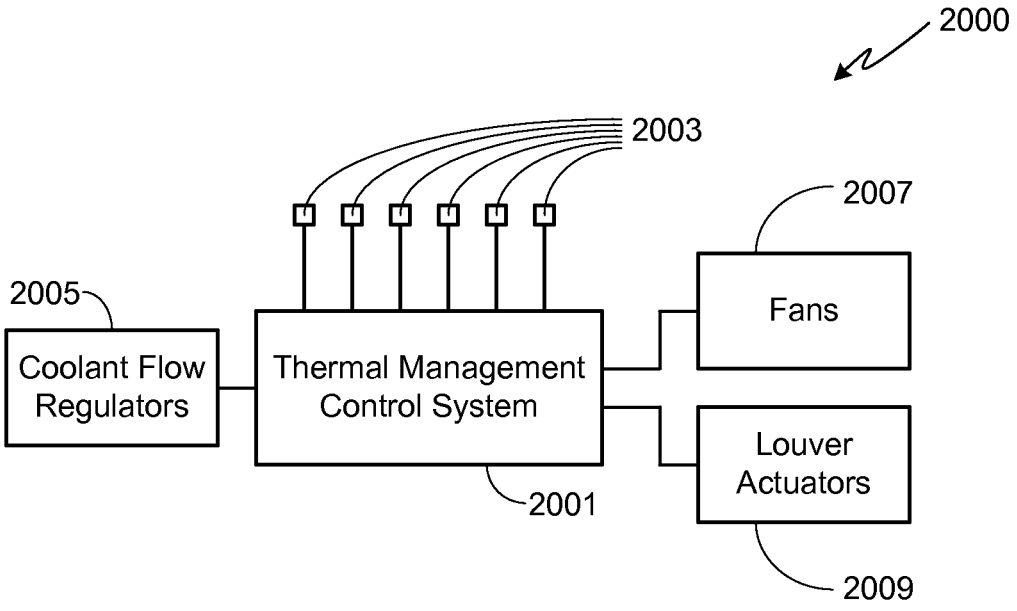
FIG. 20 provides a high-level view of the primary vehicle subsystems involved in a thermal management system designed in accordance with the invention.

FIG. 20 provides a high-level view of the primary vehicle subsystems involved in a thermal management system as described above. It will be appreciated that a vehicle can utilize other system configurations while still retaining the functionality of the present invention. Additionally, it should be understood that FIG. 20 only illustrates portions of a thermal management system and such a system may include other subsystems, depending upon the type of vehicle, power train design and configuration, battery pack composition, etc.

At the heart of system 2000 is a thermal management control system 2001. System 2001 may be integrated within another vehicle control system or configured as a stand-alone control system. Typically control system 2001 includes a control processor as well as memory for storing a preset set of control instructions. Coupled to controller 2001 are a plurality of temperature sensors 2003 that monitor the temperature of the various vehicle components in general, and the vehicle components that are coupled to the vehicle cooling systems in particular. Exemplary components that may be monitored include the battery or batteries, motor, drive electronics, transmission, and coolant. Ambient temperature is preferably monitored as well. Depending upon the configuration of the vehicle, the charging system temperature may also be monitored. The monitored temperatures of these various components, detected at various locations throughout the vehicle, are used by control system 2001 to determine the operation of the various thermal management subsystems. In addition to preferably regulating the flow of coolant within the coolant loop(s) utilizing any of a variety of regulators 2005 (e.g., circulation pump operation or flow rate, flow valves, etc.), controller 2001 preferably controls any fans 2007 used within the system (e.g., fans 305/306, 1405/1406, 1717, etc.). Controller 2001 also controls operation of the active louvers 2009 (e.g., louvers 301-304, 401-402, 1301A-C, 1302A-C, 1303A-C, 1304A-C, 1407-1410, 1725-1727, etc.). Preferably louver control is provided by electro-mechanical actuators although other means may be used (e.g., hydraulic actuators). Preferably control system 2001 is designed to operate automatically based on programming implemented by the system's processor. Alternately, system 2000 may be manually controlled, or controlled via a combination of manual and automated control.

It should be understood that identical element symbols used on multiple figures refer to the same component, or components of equal functionality. Additionally, the accompanying figures are only meant to illustrate, not limit, the scope of the invention and should not be considered to be to scale.

Systems and methods have been described in general terms as an aid to understanding details of the invention. In some instances, well-known structures, materials, and/or operations have not been specifically shown or described in detail to avoid obscuring aspects of the invention. In other instances, specific details have been given in order to provide a thorough understanding of the invention. One skilled in the relevant art will recognize that the invention may be embodied in other specific forms, for example to adapt to a particular system or apparatus or situation or material or component, without departing from the spirit or essential characteristics thereof. Therefore the disclosures and descriptions herein are intended to be illustrative, but not limiting, of the scope of the invention which is set forth in the following claims.

What is claimed is:

1. A vehicle thermal management system, comprising:

at least a first heat exchanger and second heat exchanger, wherein said first and second heat exchangers are configured in a non-stacked arrangement, and wherein said first heat exchanger is in thermal communication with a first vehicle cooling subsystem and said second heat exchanger is in thermal communication with a second vehicle cooling subsystem;

a first air inlet, wherein air flowing through said first air inlet flows directly into said first heat exchanger without first passing through said second heat exchanger;

a second air inlet, wherein air flowing through said second air inlet flows directly into said second heat exchanger without first passing through said first heat exchanger; and an active louver system, comprising:

a plurality of adjustable louvers that control air flowing directly through said second air inlet into said second heat exchanger; and an actuator coupled to said plurality of adjustable louvers, wherein said actuator controls positioning of said plurality of adjustable louvers between at least a first position and a second position;

wherein said plurality of adjustable louvers are mounted within an air inlet aperture located adjacent a bumper assembly, the bumper assembly having a fascia with a curvature;

wherein at least a first adjustable louver of said plurality of adjustable louvers is configured to pivot about a pivot axis located along a front edge portion of said first adjustable louver, the pivot axis positioned adjacent the bumper assembly; and wherein the first adjustable louver is configured and shaped to continue the curvature of the fascia of the bumper assembly when the first adjustable louver is in an open position, such that the first adjustable louver is inclined downwards from the pivot axis so as to minimize disruption of the air flowing directly through the second air inlet.

2. The vehicle thermal management system of claim 1, wherein said actuator is an electro-mechanical actuator.

3. The vehicle thermal management system of claim 1, wherein said actuator is a hydraulic actuator.

4. The vehicle thermal management system of claim 1, wherein said first position of said plurality of adjustable louvers is fully opened and said second position of said plurality of adjustable louvers is fully closed.

5. The vehicle thermal management system of claim 1, wherein said actuator controls positioning of said plurality of adjustable louvers over a range of positions.

6. The vehicle thermal management system of claim 1, wherein said plurality of adjustable louvers are coupled together using multiple links of a multi-link system.

7. The vehicle thermal management system of claim 1, further comprising a control processor coupled to said actuator, wherein said control processor controls positioning of said plurality of adjustable louvers via said actuator.

8. The vehicle thermal management system of claim 1, further comprising a fan adjacent to an airflow exit surface of said second heat exchanger.

9. The vehicle thermal management system of claim 1, further comprising an air duct that couples an airflow exit surface of at least a portion of said first heat exchanger to an airflow entrance surface of said second heat exchanger.

10. The vehicle thermal management system of claim 9, further comprising a second plurality of adjustable louvers located within said air duct and between said airflow exit surface of said first heat exchanger and said airflow entrance surface of said second heat exchanger, wherein said second plurality of adjustable louvers control air flowing between said airflow exit surface of said first heat exchanger and said airflow entrance surface of said second heat exchanger.

11. The vehicle thermal management system of claim 10, wherein said second plurality of adjustable louvers has a first position and a second position, wherein said first position of said second plurality of adjustable louvers is opened and said second position of said second plurality of adjustable louvers is closed.

12. The vehicle thermal management system of claim 10, wherein said second plurality of adjustable louvers is adjustable over a range of positions between opened and closed.

13. The vehicle thermal management system of claim 1, wherein said first heat exchanger is centrally mounted along a vehicle centerline and said second heat exchanger is mounted in a position adjacent to said first heat exchanger.

14. The vehicle thermal management system of claim 13, further comprising:

a third heat exchanger, wherein said third heat exchanger is configured in said non-stacked arrangement with said first and second heat exchangers, wherein said third heat exchanger is mounted in a position adjacent to said first heat exchanger and on an opposite side of said first heat exchanger relative to said second heat exchanger;

a third air inlet, wherein air flowing through said third air inlet flows directly into said third heat exchanger without first passing through said first or second heat exchangers; and a second active louver system, comprising:

a second plurality of adjustable louvers that control air flowing directly through said third air inlet into said third heat exchanger; and a second actuator coupled to said second plurality of adjustable louvers, wherein said second actuator controls positioning of said second plurality of adjustable louvers between at least a first position and a second position.

15. The vehicle thermal management system of claim 14, wherein operation of said first actuator is independent of operation of said second actuator.

16. The vehicle thermal management system of claim 14, further comprising a first fan adjacent to an airflow exit surface of said second heat exchanger and a second fan adjacent to an airflow exit surface of said third heat exchanger.

17. The vehicle thermal management system of claim 14, further comprising:

a first air duct that couples a first portion of an airflow exit surface of said first heat exchanger to an airflow entrance surface of said second heat exchanger; and a second air duct that couples a second portion of said airflow exit surface of said first heat exchanger to an airflow entrance surface of said third heat exchanger.

18. The vehicle thermal management system of claim 17, further comprising:

a third plurality of adjustable louvers located within said first air duct and between said airflow exit surface of said first heat exchanger and said airflow entrance surface of said second heat exchanger, wherein said third plurality of adjustable louvers control air flowing between said airflow exit surface of said first heat exchanger and said airflow entrance surface of said second heat exchanger; and a fourth plurality of adjustable louvers located within said second air duct and between said airflow exit surface of said first heat exchanger and said airflow entrance surface of said third heat exchanger, wherein said fourth plurality of adjustable louvers control air flowing between said airflow exit surface of said first heat exchanger and said airflow entrance surface of said third heat exchanger.

19. The vehicle thermal management system of claim 1, wherein a cross section of the curvature of the fascia comprises a step away from the air inlet aperture, the step accommodating the first adjustable louver in the open position.

20. The vehicle thermal management system of claim 1, further comprising fixed trim pieces rigidly mounted in the air inlet aperture, each of the fixed trim pieces paired with a corresponding one of the plurality of adjustable louvers, except the first adjustable louver, so that those ones of the plurality of adjustable louvers are aligned with respective ones of the fixed trim pieces when in the open position.

* * * * *